United States Patent [19]

Jenkins

[11] Patent Number: 4,711,383

[45] Date of Patent: Dec. 8, 1987

[54] CLOTHES HANGER CARRIER AND STORAGE CONTAINER

[76] Inventor: James E. Jenkins, 84678 Laughlin Rd., Eugene, Oreg. 97405

[21] Appl. No.: 929,794

[22] Filed: Jun. 30, 1986

Related U.S. Application Data

[63] Continuation-in-part of Ser. No. 757,145, Jul. 22, 1985, abandoned.

[51] Int. Cl.[4] ..... A45F 3/02

[52] U.S. Cl. ..... 224/202; 224/257; 224/904; 206/300

[58] Field of Search ..... 224/202, 204, 207, 208, 224/214, 250, 257, 258, 902, 904; 206/300

[56] References Cited

U.S. PATENT DOCUMENTS 3,115,968 12/1963 Peterson ..... 206/300

3,987,898 10/1976 Crane ..... 206/300

*Primary Examiner*—Recla Henry J.
*Assistant Examiner*—David Voorhees

[57] ABSTRACT

A unitary structure open at its upper end to receive a quantity of stacked clothes hangers with the hanger necks protruding through a slotted portion of the carrier front wall. Side walls of the carrier employ stiffening ribs or stiffening channels that impart rigidity; and provide strap receiving channels which confine the carrying strap therein against lateral displacement. The strap is provided with fittings to permit application and removal of the strap from an elevated support. The rear wall, the front wall, with the exception of the hanger opening area, and the adjoining corners of the side walls have outwardly turned flanges or lips that assist in reinforcing the walls, and the transferance of stress.

4 Claims, 4 Drawing Figures

CLOTHES HANGER CARRIER AND STORAGE CONTAINER

This application is a continuation-in-part of of Ser. No. 06/757,145 filed July 22, 1985, now abandoned.

BACKGROUND OF THE INVENTION

My invention relates generally to portable containers and particularly to one for the storage and convenient transport of clothes hangers.

Persons utilizing self-service and home laundries have a need to carry a quantity of clothes hangers to the laundry site for the hanging of freshly laundered garments. Present day wash and wear fabrics require that a garment be transferred immediately from a dryer to a clothes hanger to prevent wrinkling. Accordingly, a need exists for the orderly transport to and from laundry sites of a number of hangers which are inherently awkward to carry by reason of their tendency to tangle. As the user is usually encumbered with laundry and washing supplies, the task of carrying a quantity of clothes hangers is additionally burdensome. A hanger storage problem exist both at a residence as well as the time the hangers are at the laundry site. Without a specially designed container loose hangers readily become tangled.

The prior art discloses collapsible carton members and knock-down racking boxes for use by retail clothing establishments and for shipping of hangers to an end use point. U S. Pat. Nos. 3,115,968 and 3,987,898 are of interest in that they disclose knock-down boxes open at their upper ends with a front wall defined slot to receive hanger necks. Both are specifically designed to be shipped flat and assembled on site. Neither are practical, nor generally available to the public for use in the home. In addition, neither carrier is specifically designed to be carried by a strap; but is instead outfitted with a handhold by means of an opening in the back wall of each container. A planer walled container of rectangular configuration such as both of the above boxes, if equipped with a carrying strap would collapse when partially filled. The loss in structural integrity created by the opening in the front wall of the carrier would require a major innovation. My application of the principles outlined in the Detailed Description, the Description of the Drawings, and Claims would result in a carrier that would be functional, practical, lend itself to economical mass production methods, and be readily available to the general public.

Also of interest is prior art in U.S. Pat. No. 240,151 which discloses a shoulder carried soft satchel wherein a shoulder strap extents and is attached to the satchel proper at the bottom with upright segments of the strap being held in place by loops f secured to the sides of the satchel. It further relies upon a waist belt to provide additional strength to support weight within the satchel.

My invention employs the use of straps which are not attached to the carrier or dependent upon loops to be held in place. It employs a stiffening channel on both side walls to confine the strap and prevent lateral displacement. This innovation, combined with unitary construction, allows a more equal distribution of the weight of the contents to be spread throughout the surface of the carrying strap where it comes in contact with the carrier. Unlike the prior art, no waist belts are required to support the weight within the carrier.

SUMMARY OF THE PRESENT INVENTION

The present invention is embodied in a clothes hanger carrier and hanger storage unit which lends itself both to convenient use in the home as well as in transit between the home and a self-service laundry.

The carrier is of unitary construction having front, rear and side walls which generally correspond, in horizontal section, to the outline of a clothes hanger. The carrier side walls define as each having vertically extending stiffening channels from top to bottom, designed with interconnecting stiffening ribs on each sidewall to impart rigity thereto, and provide channels with which strap means are confined. Such strap means serve as both a shoulder strap and includes fittings which permit-the carrier to be suspended from support such as a clothes bar in a closet. The stiffening channels in the carrier side walls have open areas which permit passage of the strap means and additionally confine same against lateral slippage.

Important objectives of the present invention include the provision of a clothes hanger carrier which provides for both orderly storage and transport of a large number of clothes hangers without unduly encumbering the user; the provision of a clothes hanger carrier having strap means thereon confined in place along carrier walls by reinforcing channels which may be conveniently carried by a strap over the shoulder, or as a hand held carrying strap; the provision of a clothes hanger carrier having a strap means for passage over a horizontal clothes bar for convenient carrier storage in a closet; the provision wherein the strap means may be removed for storage or shipment of more than one carrier by stacking one inside the other.

DETAILED DESCRIPTION OF THE PREFERRED EMBODIMENTS

Figure 1:
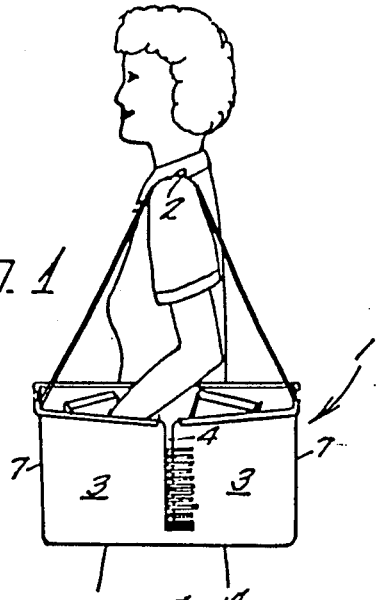
FIG. 1 is a front elevational view of the present carrier supported in place on the users shoulder.

With continuing attention to the drawings, the applied reference numeral 1 indicates generally the present carrier suspended from a support 2 such as the shoulder of the user.

The present clothes hanger carrier is preferably of molded construction having front walls 3 defining an upright opening 4 of a length and width to allow hanger necks to slide therein. Front walls 3 converge forwardly toward opening 4. A back wall is at 5 while a bottom wall is at 6. Side walls are at 7. Flanges or lips at 8 extend outwardly from the wall upper extremities and combine with stiffening channel 10 and stiffening ribs 14 to impart rigidity thereto.

Figure 2:
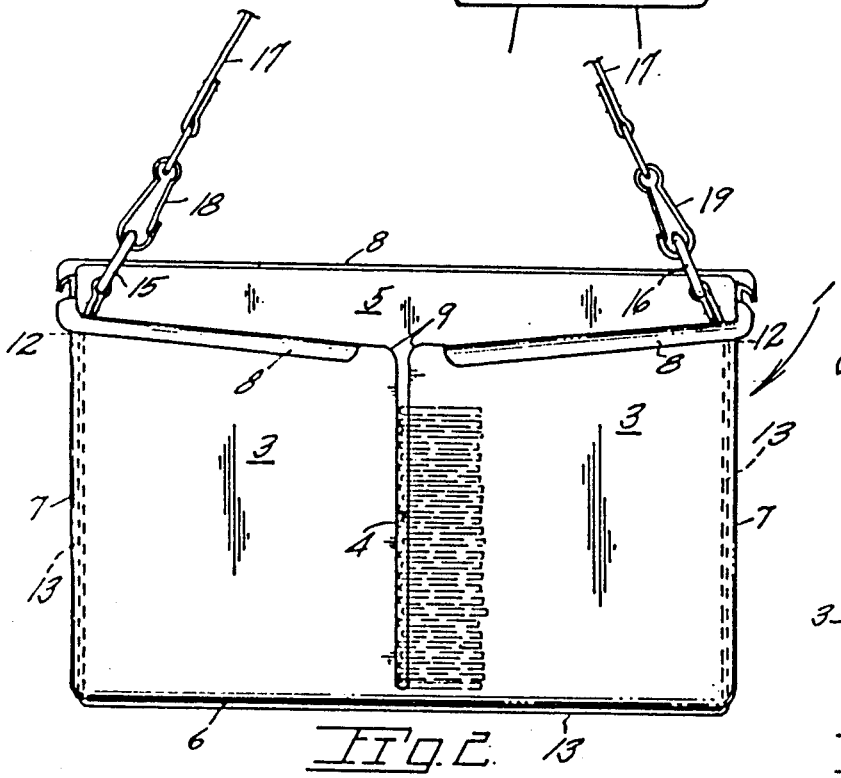
FIG. 2 is an enlarged front elevational view of the carrier.
Figure 3:
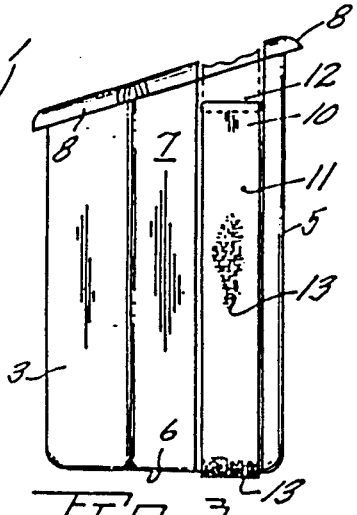
FIG. 3 is a side elevational view taken from the right side of FIG. 2 showing the strap means passing into the carrier.
Figure 4:
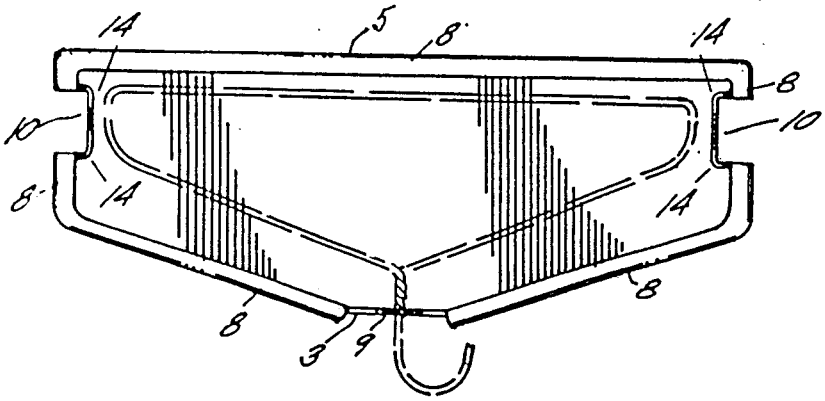
FIG. 4 is a plan view of FIG. 2 with the strap means removed.

Front wall 3, in frontal elevation in FIG. 2, has downwardly and inwardly sloped flanges 9 to facilitate hanger insertion and removal. The opening is substantially the height of the front wall.

Side walls 7 each define a vertically extending stiffening channel area 10 occupied by segments of strap means at 11. Such stiffening channels in the side walls are formed by stiffening ribs 14 and impart rigidity to the overall carrier as well as confines the strap mean against lateral displacement. Opening areas at 12 near the top of stiffening channels 10 permit inward strap passage to the interior of the carrier, and provide additional confinement to prevent strap displacement.

The strap means includes a first strap at 13 which passes about the carrier and terminates upwardly and inwardly in an inclined manner at its ends in "D" rings 15 and 16. A second strap 17 is fitted at its ends with hooks 18 and 19 for "D" ring engagement in a detachable manner permitting the second strap 17 to be passed over a support and reattached to a "D" ring for suspending the carrier from an elevated stationary support such as a closet clothes bar. As garments are removed from the clothes hangers, the hangers may be placed in the present carrier supported at a convenient height within the clothes closet by means of strap 17. Preparatory to a trip to a self-service laundry, the strap means is removed from the supporting clothes bar and serves to conveniently support carrier from the user's shoulder. The open configuration of clothes hangers permits various items such as laundry supplies to be carried in the carrier.

The confinement of the strap in the stiffening channel 10 of the side walls and passage through the open area 12 into the interior of the carrier near the upper end of the channel prevents any tendency of the carrier to tip even when fully loaded with metal clothes hangers and laundry supplies. The present strap mounting arrangement precludes the costly mounting, during manufacture, of various metal fittings to the carrier walls.

Having thus described the invention, what is desired to be secured in a Letters Patent is:

1. A unitarily constructed, rigid, portable carrier for clothes hangers comprising, a, walled structure having front, rear, and bottom walls and a pair of side walls, said front wall defining and opening for the reception of hanger necks and an interior defined by said walls, each of said side walls having a stiffening channel formed by interconnecting stiffening ribs for imparting rigidity to said side walls, and, a strap for supporting said walled structure, said strap adapted to be retained in said stiffening channel when said walled structure is supported by said strap.

2. The carrier claimed in claim 1 wherein said side walls define an opening in a portion of said stiffening channel and spaced from said bottom wall for the inclined passage of said strap into the interior of said walled structure.

3. The carrier claimed in claim 1 wherein said strap includes fittings facilitating temporary unfastening of said strap and passage of said strap over a fixed support.

4. The carrier claimed in claim 1 wherein each of said front, rear and side walls terminates in an outwardly extending flange or lip interlocked to said side wall thereby increasing the rigidity of said walled structure.

* * * * *